US010287150B1

(12) United States Patent
Miller

(10) Patent No.: US 10,287,150 B1
(45) Date of Patent: May 14, 2019

(54) MOBILE PLATFORM CARRYING SYSTEM

(71) Applicant: Ford Miller Holding Company, LLC, Marion, NC (US)

(72) Inventor: Clifford F. Miller, Marion, NC (US)

( * ) Notice: Subject to any disclaimer, the term of this patent is extended or adjusted under 35 U.S.C. 154(b) by 0 days.

(21) Appl. No.: 15/863,865

(22) Filed: Jan. 6, 2018

(51) Int. Cl.

| | |
|---|---|
| ***B66F 11/04*** | (2006.01) |
| ***B66F 7/28*** | (2006.01) |
| ***B66F 7/14*** | (2006.01) |
| ***E01D 21/00*** | (2006.01) |
| ***E04G 3/34*** | (2006.01) |
| ***E01D 19/10*** | (2006.01) |
| ***E04G 3/28*** | (2006.01) |

(52) U.S. Cl.
CPC ..... *B66F 11/046* (2013.01); *B66F 7/14* (2013.01); *B66F 7/28* (2013.01); *E01D 19/10* (2013.01); *E01D 21/00* (2013.01); *E04G 3/28* (2013.01); *E04G 3/34* (2013.01)

(58) Field of Classification Search
CPC .... E04G 3/28; E04G 3/34; E04G 1/18; E01D 19/106; B66F 11/046
See application file for complete search history.

(56) References Cited

U.S. PATENT DOCUMENTS 3,159,110 A * 12/1964 Wylie ..... E04G 3/34 104/246
3,232,377 A * 2/1966 Smith ..... E04G 1/18 182/115
3,311,193 A * 3/1967 Eitel ..... B66F 11/046 182/148
3,592,070 A * 7/1971 Hammond ..... B66F 3/10 74/89.35
3,610,367 A * 10/1971 Atchey ..... B66F 11/046 182/2.5
4,154,318 A * 5/1979 Malleone ..... E04G 3/28 182/12

(Continued)

FOREIGN PATENT DOCUMENTS

CA 2932872 A1 * 12/2017 ..... E04G 1/24
CN 2761682 Y 3/2006

(Continued)

OTHER PUBLICATIONS

Title: Highways Date Accessed: Aug. 31, 2017 Source: Bridge Access Specialties URL: http://www.bridgeaccessspecialties.com/highways.php.

(Continued)

*Primary Examiner* — Marcus Menezes
(74) *Attorney, Agent, or Firm* — Law Office of Michael O'Brien

(57) ABSTRACT

A mobile platform carrying system is configured to be adjusted to remain level. The mobile platform carrying system includes a chassis, attached to a front axle assembly and a rear axle assembly. The front axle assembly includes a front axle housing through which a front axle telescoping portion extends. A first front wheel housing is joined to the front axle telescoping portion, and a first front actuator. The first front actuator is adapted to adjust a front linear position of the first front wheel housing relative to the chassis. A first front wheel is joined to the first front wheel housing with a first front hinge. The rear axle assembly is similarly arranged.

20 Claims, 7 Drawing Sheets

(56) References Cited

U.S. PATENT DOCUMENTS

| | | | | | |
|---|---|---|---|---|---|
| 4,179,010 | A * | 12/1979 | Ashworth | B66F 11/046 182/2.11 |
| 4,206,833 | A | 6/1980 | Goyarts | |
| 4,696,371 | A | 9/1987 | Moog | |
| 5,159,989 | A * | 11/1992 | Claxton | B60S 9/12 180/41 |
| 5,253,731 | A | 10/1993 | Moog | |
| 5,318,149 | A | 6/1994 | Moog | |
| 5,435,410 | A * | 7/1995 | Langston | B66C 23/78 182/2.6 |
| 6,443,687 | B1 * | 9/2002 | Kaiser | E02F 9/024 180/209 |
| 6,598,702 | B1 * | 7/2003 | McGillewie, Jr. | E01D 19/106 182/2.6 |
| 8,888,122 | B2 * | 11/2014 | Berry | B66C 23/62 180/212 |
| 9,695,024 | B2 * | 7/2017 | Herauf | B66F 11/044 |
| 9,776,846 | B2 * | 10/2017 | Ditty | B66F 17/006 |
| 2013/0020775 | A1 * | 1/2013 | Beji | B60B 35/10 280/43 |
| 2017/0341566 | A1 * | 11/2017 | Luminet | B60Q 1/245 |

FOREIGN PATENT DOCUMENTS

| | | | | |
|---|---|---|---|---|
| CN | 102071638 | A | 5/2011 | |
| CN | 202595622 | U | 12/2012 | |
| CN | 103123016 | A | 5/2013 | |
| CN | 203834369 | U | 9/2014 | |
| CN | 203923926 | U | 11/2014 | |
| CN | 104192769 | A | 12/2014 | |
| CN | 204212065 | U | 3/2015 | |
| CN | 204418013 | U | 6/2015 | |
| CN | 105735140 | A | 7/2016 | |
| CN | 205501842 | U | 8/2016 | |
| CN | 105239515 | B | 4/2017 | |
| DE | 3305384 | A1 | 3/1984 | |
| DE | 8805760 | U1 | 7/1988 | |
| GB | 1321051 | A | 6/1973 | |
| GB | 1515114 | A | 6/1978 | |
| GB | 2263681 | A * | 1/1992 | B66B 5/12 |
| JP | 10088521 | A | 4/1998 | |
| JP | 2009057685 | A | 3/2009 | |
| JP | 2009235687 | A | 10/2009 | |

OTHER PUBLICATIONS

Title: Bridge Inspection Rental Equipment Date Accessed: Aug. 31, 2017 Source: TRL Rents URL: http://www.trlrents.com/Bridge-Inspection-Rental.html.

Title: Terex Hydra HPT 11/38 Access Platform Date Accessed: Mar. 30, 2017 Source: Construction Equipment URL: https://www.constructionequipment.com/terex-hydra-hpt-1138-access-plafform.

* cited by examiner

MOBILE PLATFORM CARRYING SYSTEM

BACKGROUND

The embodiments herein relate generally to machines that are used to move users below a ground surface in a bridge construction setting.

Prior to embodiments of the disclosed invention, machines existed that could move users below a ground surface, but those machines only operated on solid level ground. Some examples of these efforts include: U.S. Pat. Nos. 5,253,373, 5,318,149 and 4,696,371 all issued to Moog; U.S. Pat. No. 4,154,318 issued to Malleone, Chinese Patent 2,761,682 issued to Sun; UK Patent 1,515,114 issued to Harrison; UK Patent 1,321,051 issued to Bartoli; and Chinese Patent 102,071,638 issued to Hao.

SUMMARY

A mobile platform carrying system is configured to be adjusted to remain level. The mobile platform carrying system includes a chassis, attached to a front axle assembly and a rear axle assembly. The front axle assembly includes a front axle housing through which a front axle telescoping portion extends. A first front wheel housing is joined to the front axle telescoping portion, and a first front actuator. The first front actuator is adapted to adjust a front linear position of the first front wheel housing relative to the chassis. A first front wheel is joined to the first front wheel housing with a first front hinge. The rear axle assembly includes a rear axle housing through which a rear axle telescoping portion extends. A first rear wheel housing is joined to the rear axle telescoping portion, and a first rear actuator. The first rear actuator is adapted to adjust a rear linear position of the first rear wheel housing relative to the chassis. A first rear wheel is joined to the first rear wheel housing with a first rear hinge.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
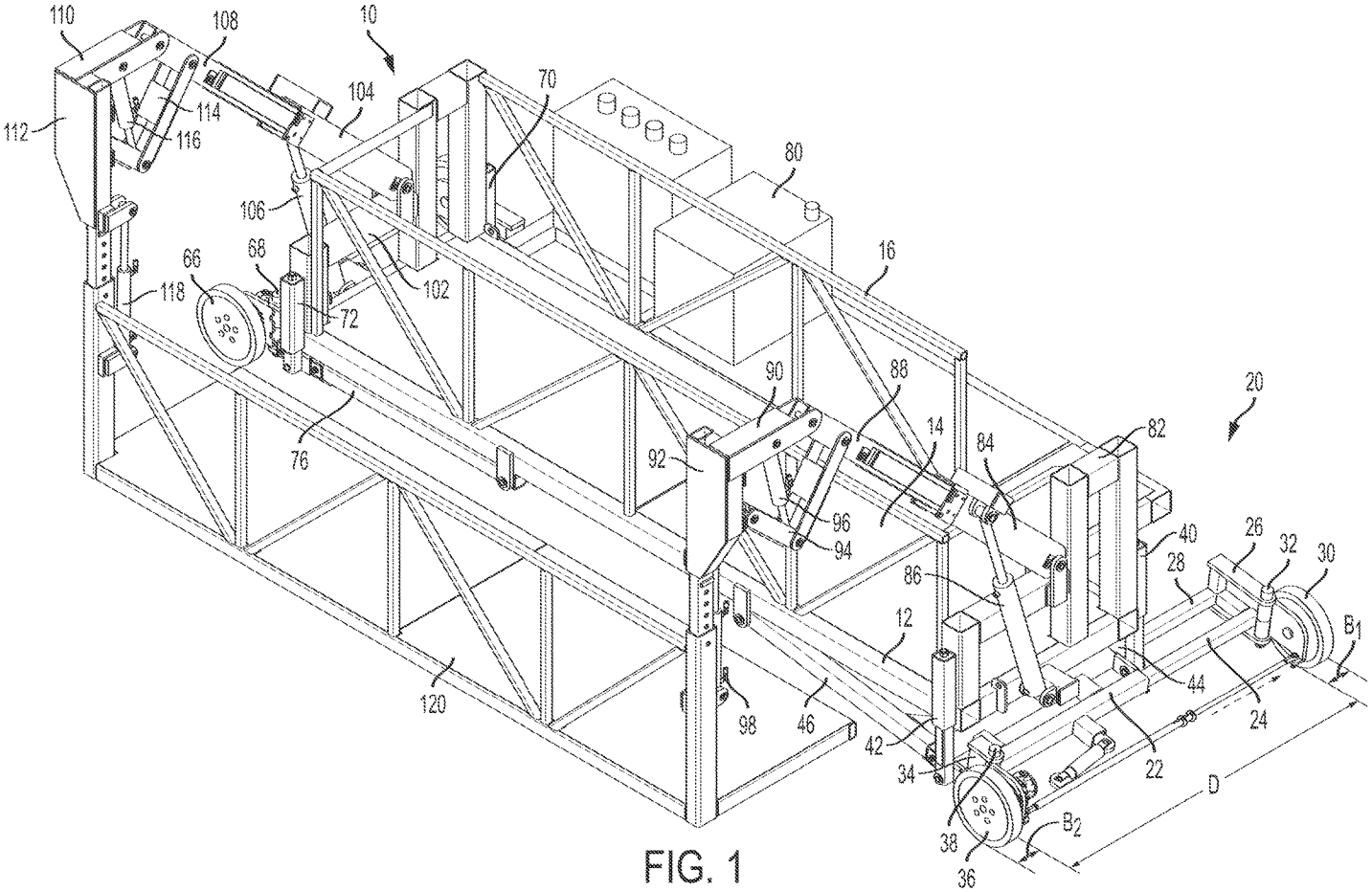
FIG. 1 shows a schematic perspective view of one embodiment of the present invention.
Figure 2:
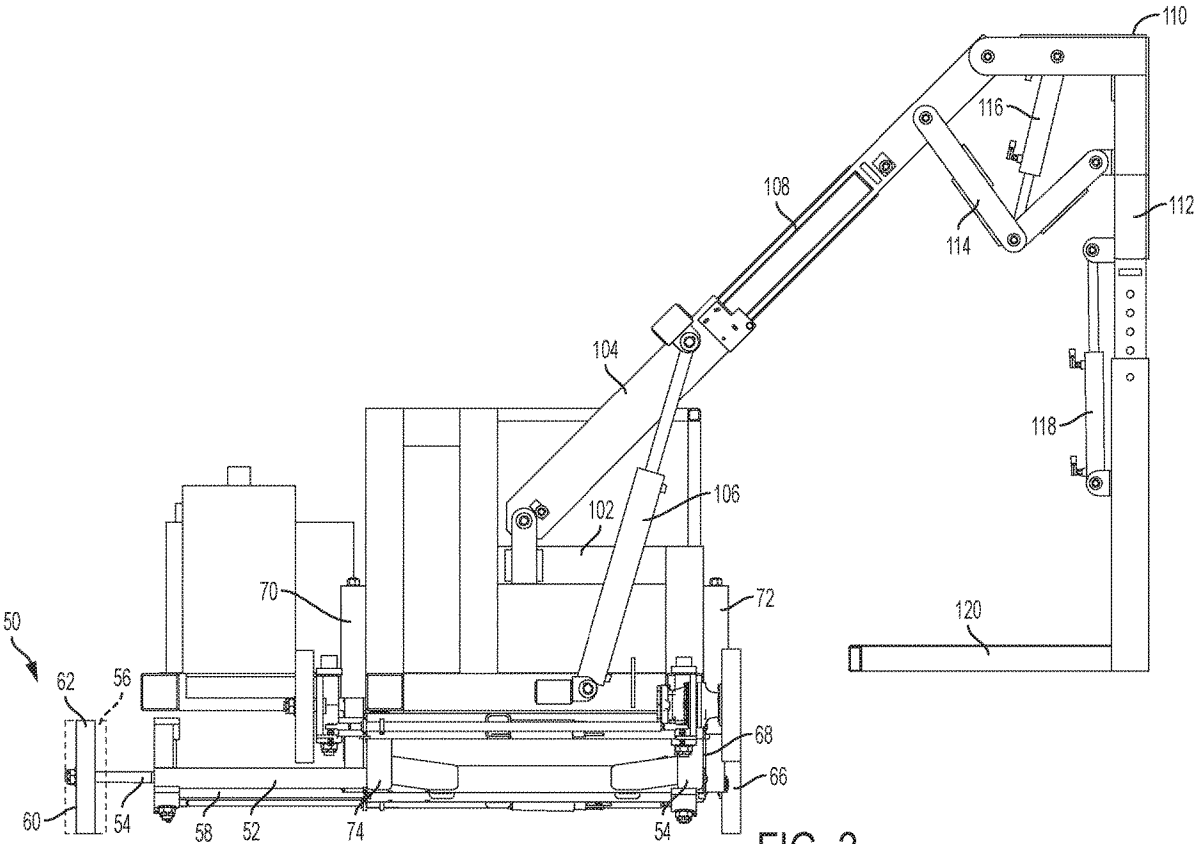
FIG. 2 shows a side view of one embodiment of the present invention.
Figure 3:
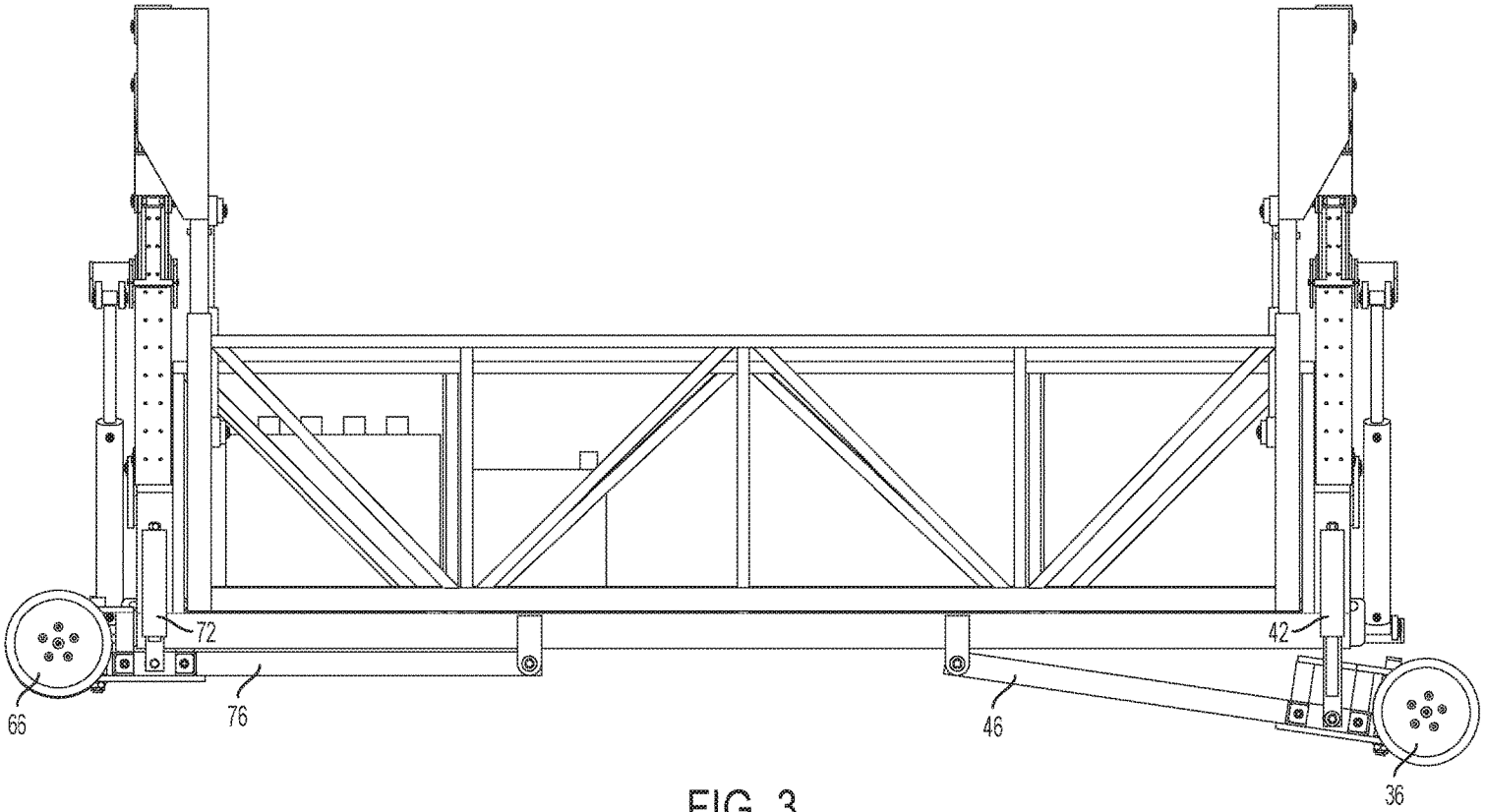
FIG. 3 shows a front view of one embodiment of the present invention.
Figure 4:
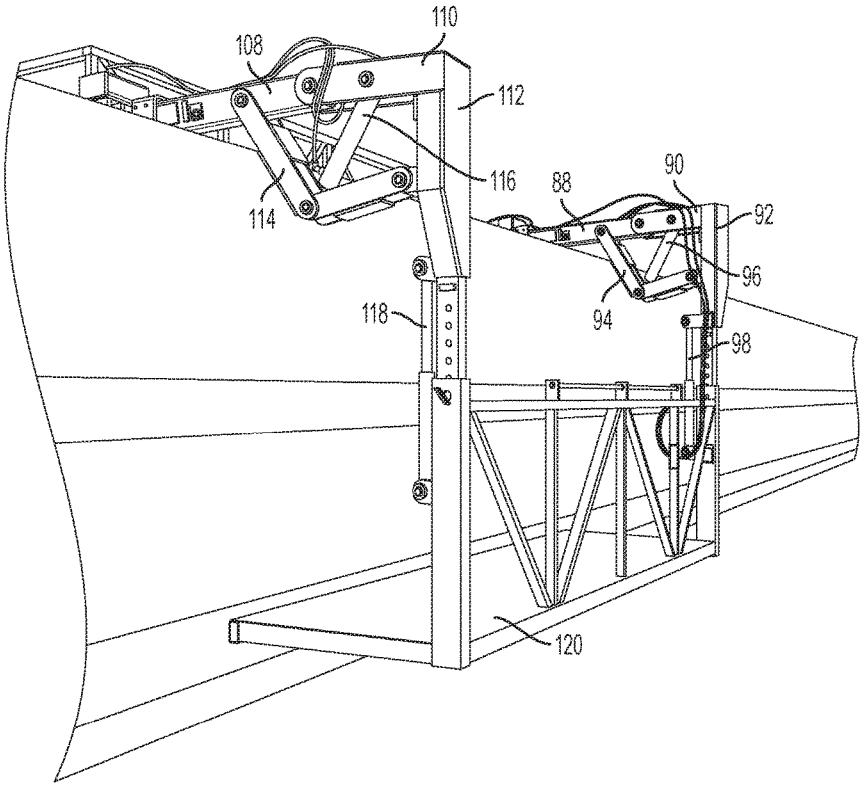
FIG. 4 shows a detail perspective view of one embodiment of the present invention.
Figure 5A:
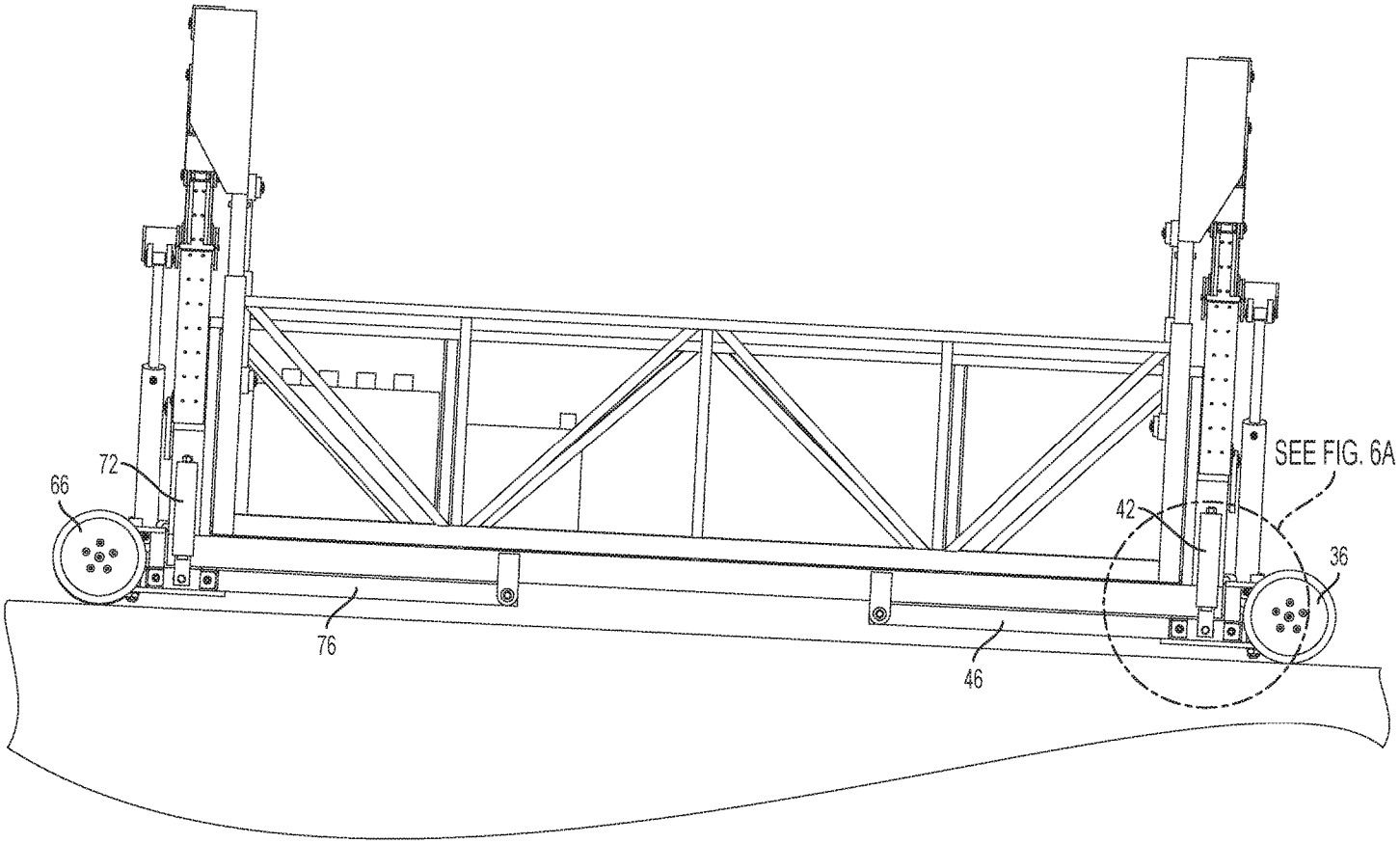
FIG. 5A shows a side view of one embodiment of the present invention in an unleveled state.
Figure 5B:
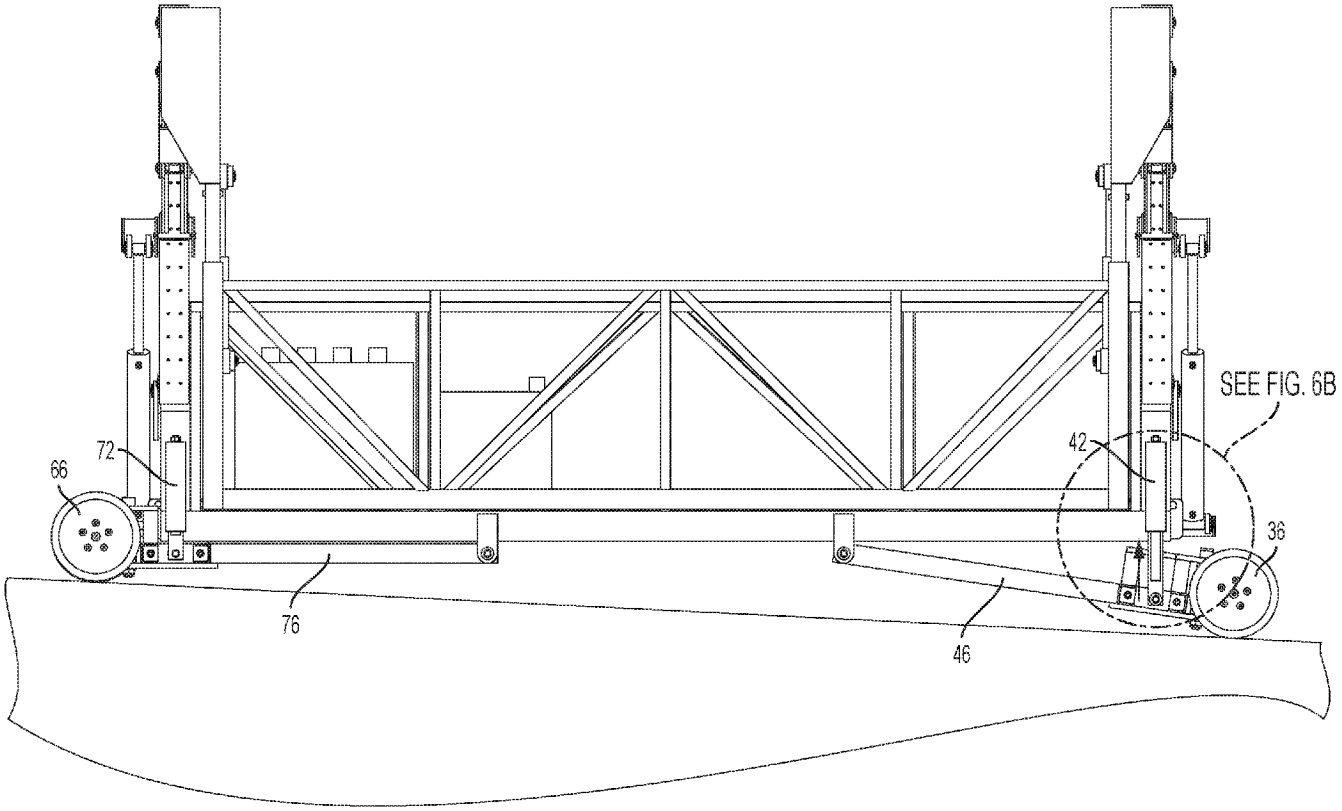
FIG. 5B shows a side view of one embodiment of the present invention in a leveled state.
Figure 6A:
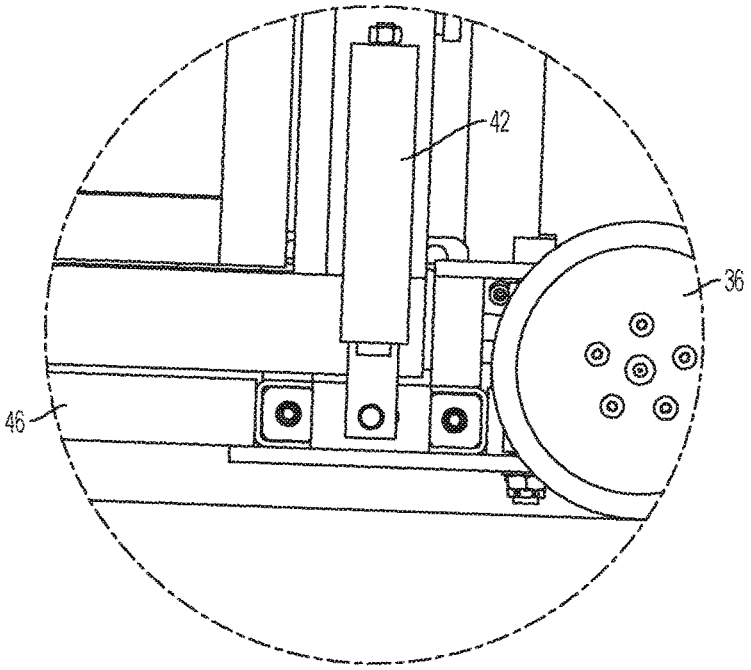
FIG. 6A shows a detail side view of one embodiment of the present invention in an unleveled state.
Figure 6B:
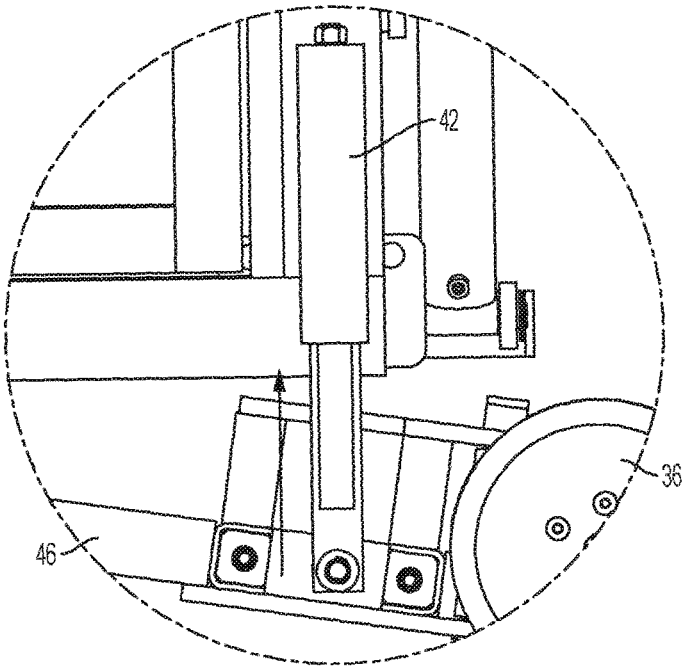
FIG. 6B shows a detail side view of one embodiment of the present invention in a leveled state.

By way of example, and referring to FIG. 1, one embodiment of a mobile platform carrying system 10 comprises a chassis 12. The chassis 12 is attached to a chassis platform

14 and a guard rail system 16. The chassis 12 is further attached to a front axle assembly 20 and a rear axle assembly 50.

The front axle assembly 20 further comprises a front axle housing 22 through which a front axle telescoping portion 24 extends. The front axle telescoping portion 24 is joined to a first front wheel housing 26. The first front wheel housing 26 is joined to a first front actuator 28. The first front actuator 28 is adapted to adjust a front linear position of the first front wheel housing 26 relative to the chassis 12. The first front wheel housing 26 is further joined to a first front wheel 30 with a first front hinge 32.

The front axle housing 22 is further attached to a second front wheel housing 34. The second front wheel housing 34 is connected to a second front wheel 36 with a second front hinge 38. The front axle housing 22 is further attached to a first front screw jack 40 and a second front screw jack 42. The front axle housing 22 is further attached to a first front pivot support arm 44 and a second front pivot support arm 46.

The rear axle assembly 50 further comprises a rear axle housing 52 through which a rear axle telescoping portion 54 extends. The rear axle telescoping portion 54 is joined to a first rear wheel housing 56. The first rear wheel housing 56 is joined to a first rear actuator 58. The first rear actuator 58 is adapted to adjust a rear linear position of the first rear wheel housing 56 relative to the chassis 12. The first rear wheel housing 56 is further joined to a first rear wheel 60 with a first rear hinge 62.

The rear axle housing 52 is further attached to a second rear wheel housing 64. The second rear wheel housing 64 is connected to a second rear wheel 66 with a second rear hinge 68. The rear axle housing 52 is further attached to a first rear screw jack 70 and a second rear screw jack 72. The rear axle housing 52 is further attached to a first rear pivot support arm 74 and a second rear pivot support arm 76.

In use, the mobile platform carrying system 10 can be used for building a bridge. This can be dangerous, at first, because before the ground of the bridge is laid a vehicle must travel on narrow beams B1, B2, that are arranged a known distance D from one another. However, that known distance D varies from bridge to bridge. Embodiments of the disclosed invention solve this problem by using actuators powered by hydraulic system 80 in order to adjust the linear position of the first front wheel housing 26 and the first rear wheel housing 56 in order to be set the known distance D between the narrow beams B1, B2.

In the second instance, building a bridge from a platform can be dangerous because the beams are rarely arranged at a uniform height. Bridges, like all roads, have curved surfaces for drainage and many other reasons. This would seem to create a balance issue for the mobile platform carrying system 10. However, that problem is solved by using the first front screw jack 40, the second front screw jack 42, the first rear screw jack 70, and the second rear screw jack 72, in order to ensure that the platform 14 is level in all directions. While screw jacks generally refer to manual devices that rotate to expand, that device is a species of what this application calls a "lift assembly" which means any hydraulic, manual, or pneumatic system that can lift a platform. Accordingly, there can be a first front lift assembly, a second front lift assembly, a first rear lift assembly and a second rear lift assembly.

The chassis 12 is mechanically coupled to front support structure 82. The front support structure is rotatable coupled to a front telescoping arm 84. The front telescoping arm 84 is attached to the chassis 12 with a front telescoping actuator 86. The front telescoping arm 84 is attached to a front expansion arm 88. The front expansion arm 88 is attached to a front distal end linkage 90. The front distal end linkage 90 is further attached to a front platform attachment linkage 92. The front platform attachment linkage 92 is further attached to the front expansion arm 88 with a front two-linkage connection 94. The front two-linkage connection 94 is attached to the front distal end linkage 90 with a front linkage actuator 96. The front platform attachment linkage 92 is adjustable with a front platform height actuator 98.

The chassis 12 is mechanically coupled to rear support structure 102. The rear support structure is rotatable coupled to a rear telescoping arm 104. The rear telescoping arm 104 is attached to the chassis 12 with a rear telescoping actuator 106. The rear telescoping arm 104 is attached to a rear expansion arm 108. The rear expansion arm 108 is attached to a rear distal end linkage 110. The rear distal end linkage 110 is further attached to a rear platform attachment linkage 112. The rear platform attachment linkage 112 is further attached to the rear expansion arm 108 with a rear two-linkage connection 114. The rear two-linkage connection 114 is attached to the rear distal end linkage 110 with a rear linkage actuator 116. The rear platform attachment linkage 112 is adjustable with a rear platform height actuator 118.

A mobile platform 120 is attached to the front platform attachment linkage 92 and the rear platform attachment linkage 112. As noted above, a difficulty in this field of endeavor is ensuring that chassis platform 14 is level. It is further challenging to ensure that mobile platform 120 is level. A goal of the mobile platform carrying system 10 is to ensure that the chassis platform 14 is parallel to the mobile platform 120 even while the mobile platform 120 is moving outward, downward, and then inward. To accomplish this the front linkage actuator 96 and the rear linkage actuator 116 operate in tandem to make minor corrections in the angle of the mobile platform 120 in order to ensure that the mobile platform 120 remains level while moving.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶ 6. In particular, any use of "step of" in the claims is not intended to invoke the provision of 35 U.S.C. § 112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A mobile platform carrying system, configured to be adjusted to remain level, the mobile platform carrying system further comprising:

a chassis, attached to a front axle assembly and a rear axle assembly;

wherein the front axle assembly further comprises:

a front axle housing through which a front axle telescoping portion extends;

a first front wheel housing, having a forward portion and a rearward portion, wherein the forward portion is directly attached to the front axle telescoping portion, and the rearward portion is directly attached to a first front actuator such that the front axle telescoping portion and the first front actuator are parallel to one another and separated from one another; wherein the first front actuator is adapted to adjust a front linear position of the first front wheel housing relative to the chassis;

a first front wheel is joined to the first front wheel housing with a first front hinge;

a second front wheel, joined to the first front wheel with a telescoping rod; wherein the telescoping rod is parallel to and separated from the front axle telescoping portion and the first front actuator;

wherein the rear axle assembly further comprises:

a rear axle housing through which a rear axle telescoping portion extends;

a first rear wheel housing, joined to the rear axle telescoping portion, and a first rear actuator; wherein the first rear actuator is adapted to adjust a rear linear position of the first rear wheel housing relative to the chassis;

a first rear wheel is joined to the first rear wheel housing with a first rear hinge.

2. The mobile platform carrying system of claim 1, wherein the front axle assembly further comprises a second front wheel housing, attached to the second front wheel with a second front hinge and to the front axle housing.

3. The mobile platform carrying system of claim 2, further comprising: a first front lift assembly, joined to the chassis and the front axle housing proximate the first front wheel housing.

4. The mobile platform carrying system of claim 3, further comprising: a second front lift assembly, joined to the chassis and the front axle housing proximate the second front wheel housing.

5. The mobile platform carrying system of claim 4, wherein the first front lift assembly is a first front screw jack and the second front lift assembly is a second front screw jack.

6. The mobile platform carrying system of claim 5, wherein the rear axle assembly further comprises a second rear wheel housing, attached to a second rear wheel with a second rear hinge and to the rear axle housing.

7. The mobile platform carrying system of claim 6, further comprising: a first rear lift assembly, joined to the chassis and the rear axle housing proximate the first rear wheel housing.

8. The mobile platform carrying system of claim 7, further comprising: a second rear lift assembly, joined to the chassis and the rear axle housing proximate the second rear wheel housing.

9. The mobile platform carrying system of claim 8, wherein the first rear lift assembly is a first rear screw jack and the second rear lift assembly is a second rear screw jack.

10. The mobile platform carrying system of claim 1, further comprising a front support structure.

11. The mobile platform carrying system of claim 10, further comprising a front telescoping arm, rotationally coupled to the chassis with a front telescoping actuator and further attached to the front support structure.

12. The mobile platform carrying system of claim 11, further comprising a front expansion arm, joined to the front telescoping arm and configured to slide in and out of the front telescoping arm; and further joined to a front distal end linkage.

13. The mobile platform carrying system of claim 12, further comprising a front platform attachment linkage, rotationally connected to the front distal end linkage and further attached to the front expansion arm with a front two-linkage connection.

14. The mobile platform carrying system of claim 13, further comprising a front linkage actuator, joining the front two-linkage connection and the front distal end linkage.

15. The mobile platform carrying system of claim 14, further comprising a rear support structure.

16. The mobile platform carrying system of claim 15, further comprising a rear telescoping arm, rotationally coupled to the chassis with a rear telescoping actuator; and the rear telescoping arm is further joined to the rear support structure.

17. The mobile platform carrying system of claim 16, further comprising a rear expansion arm, joined to the rear telescoping arm and configured to slide in and out of the rear telescoping arm; and further joined to a rear distal end linkage.

18. The mobile platform carrying system of claim 17, further comprising a rear platform attachment linkage, rotationally connected to the rear distal end linkage and further attached to the rear expansion arm with a rear two-linkage connection.

19. The mobile platform carrying system of claim 18, further comprising a rear linkage actuator, joining the rear two-linkage connection and the rear distal end linkage.

20. The mobile platform carrying system of claim 1, wherein the telescoping rod rotates the first front wheel and the second front wheel in order to act as a telescoping steering rod.

* * * * *